US008695308B2

(12) United States Patent
Falk et al.

(10) Patent No.: US 8,695,308 B2
(45) Date of Patent: Apr. 15, 2014

(54) METHOD FOR MOUNTING FAçADE ELEMENTS ON A MULTI-STOREY BUILDING

(75) Inventors: Jon Henrik Falk, Stockholm (SE); David Fredrik Augustinson, Stockholm (SE)

(73) Assignee: Brunkeberg Systems AB, Höganäs (SE)

( * ) Notice: Subject to any disclaimer, the term of this patent is extended or adjusted under 35 U.S.C. 154(b) by 311 days.

(21) Appl. No.: 13/140,211

(22) PCT Filed: Dec. 18, 2009

(86) PCT No.: PCT/EP2009/067481
§ 371 (c)(1),
(2), (4) Date: Jun. 16, 2011

(87) PCT Pub. No.: WO2010/070082
PCT Pub. Date: Jun. 24, 2010

(65) Prior Publication Data

US 2012/0031036 A1 Feb. 9, 2012

Related U.S. Application Data

(60) Provisional application No. 61/139,266, filed on Dec. 19, 2008.

(51) Int. Cl.
*E04B 1/00* (2006.01)

(52) U.S. Cl.
USPC ..... 52/745.21

(58) Field of Classification Search
USPC ..... 52/745.21, 127.1, 127.2, 122.1, 234, 52/235, 408, 79.1
See application file for complete search history.

(56) References Cited

U.S. PATENT DOCUMENTS 3,239,990 A * 3/1966 Adler ..... 52/745.04
3,525,186 A * 8/1970 Lombardo ..... 52/125.6
(Continued)

FOREIGN PATENT DOCUMENTS

DE 4336142 A1 * 4/1995
JP 01-006436 1/1989
(Continued)

*Primary Examiner* — Mark Wendell
*Assistant Examiner* — Keith Minter
(74) *Attorney, Agent, or Firm* — Dilworth & Barrese, LLP.

(57) ABSTRACT

The present invention relates to a method for mounting facade elements (12, 12*b-c*) on a multi-story building by means of a profile system comprising a first type of vertical profile (1*a-d*) having a slot extending along the longitudinal axis of the profile, and an inner part of the slot being designed to receive an edge of a first facade element and an outer part of the slot being designed to receive and support a second type of vertical profile, provided with a groove extending along the longitudinal axis of the profile and designed to receive and support an edge of a second facade element. The method comprises: a) mounting two vertical profiles (1*a-b*) of the first type at a second floor of the building so that the slots are facing each other, and above profiles (1*c-d*) of the first and second type previously mounted on a first floor, b) transporting a facade element (12), guided by the grooves of the profiles mounted on the first floor until it reaches the vertical profiles mounted on the second floor, c) entering the facade element into the outer part of the slots of the vertical profiles mounted on the second floor, d) continuing transporting the facade element, guided by the outer part of the slots to a mounting position, e) pushing the facade element from the outer part of the slots to the inner part of the slots, f) attaching the facade element to the building, and g) inserting vertical profiles of the second type into the outer part of the slots.

20 Claims, 12 Drawing Sheets

(56) References Cited

U.S. PATENT DOCUMENTS

| | | | | | |
|---|---|---|---|---|---|
| 3,791,094 | A * | 2/1974 | Shannon, Jr. | 52/747.1 |
| 4,073,104 | A * | 2/1978 | Bolanz | 52/125.2 |
| 4,591,308 | A | 5/1986 | Imai | |
| 5,181,825 | A * | 1/1993 | Sugitani et al. | 414/800 |
| 5,579,624 | A * | 12/1996 | Aeberhard | 52/586.2 |
| 5,688,095 | A * | 11/1997 | Knudson | 414/12 |
| 5,863,169 | A * | 1/1999 | Inkeroinen | 414/11 |
| 5,934,038 | A * | 8/1999 | Clausen | 52/745.2 |
| 6,658,804 | B2 * | 12/2003 | Leytes et al. | 52/235 |
| 7,043,884 | B2 * | 5/2006 | Moreno | 52/235 |
| 8,322,102 | B2 * | 12/2012 | Krieger | 52/489.1 |
| 2003/0110726 | A1 * | 6/2003 | Rudduck | 52/474 |
| 2004/0182019 | A1 * | 9/2004 | Flynn | 52/127.2 |
| 2010/0300021 | A1 * | 12/2010 | Falk | 52/235 |
| 2011/0258945 | A1 * | 10/2011 | Arbour | 52/173.3 |
| 2012/0233944 | A1 * | 9/2012 | Reifer | 52/235 |
| 2012/0291397 | A1 * | 11/2012 | Bergman | 52/745.21 |
| 2013/0118107 | A1 * | 5/2013 | Maday et al. | 52/506.05 |

FOREIGN PATENT DOCUMENTS

| | | |
|---|---|---|
| JP | 07-062871 | 3/1995 |
| WO | 2009/093948 | 7/2009 |

* cited by examiner

A - A

METHOD FOR MOUNTING FAçADE ELEMENTS ON A MULTI-STOREY BUILDING

CROSS-REFERENCE TO RELATED APPLICATIONS

The present application is a national stage of international application no. PCT/EP2009/067481 filed Dec. 18, 2009 and which claims benefit of prior U.S. provisional application No. 61/139,266 filed Dec. 19, 2008.

FIELD OF THE INVENTION AND PRIOR ART

The present invention relates to a method for mounting facade elements on a multi-storey building.

Multi-storey buildings may be constructed in a plurality of ways. Common for all of them is that they comprise a facade. The facade may be provided in a large number of different ways and may either constitute a load bearing part of the multi-storey building or only serve as weather protection. In the latter case the building comprises a building structure on which plate formed facade elements are attached. The plate formed facade elements may comprise one or more different kinds of facade elements.

The facade elements are often transported to the working site on pallets. These pallets are traditionally off-loaded from a delivery truck by a tower crane and then lifted to the floor where the facade elements will be installed. The tower crane is a critical resource. Waiting time for trucks and tower cranes generate waste time and substantial costs.

The handling of the facade elements during mounting on the building is sensitive and facade elements may be damaged during handling. During hoisting of facade elements there is a risk for the elements to crash into earlier mounted elements or other parts of the building or nearby equipment and damages may arise. These risks increase during mounting in windy conditions, which may lead to a standstill in the facade installation process while awaiting calmer weather.

The facade elements are usually lifted to the installation level on the building using tower cranes which have the purpose of lifting building material to different parts of the building. The methods used for installation is either direct assembly of facade elements one by one by the tower crane, or using the tower crane for lifting pallets of façade elements to the installation floor from which final installation is made using mobile mini cranes one floor above installation level. The positioning of panels on the floors is a problem since staged panels occupy space on each floor that must be left unobstructed by other trades, and also requires detailed instructions from the structural designer due to limited early concrete strength. Both these methods is weather dependent and hoisting large facade elements using the tower crane is a critical resource.

In "De-coupling cladding installation from other high-rise building trades: a case study, proc. 9$^{th}$ Annual conference of the International group for lean construction—IGLC 9, Singapore, 6-8 Aug. 2001", a method for hoisting facade elements on a multi-storey building without the use of tower cranes is described. For hoisting of facade elements one or more cranes are described which can successively be placed on the floors during the erection of the building and which comprises supports for a cable guided lifting device in which the facade element may be trans-ported to the desired height in the building. The facade elements can then be distributed horizontally to the desired place using a traverse collar arranged to be temporarily anchored on the building structure around the entire building and which may be moved continuously upward in the building. After finishing mounting of facade elements all parts which have been intended for hoisting and distribution of facade elements to the intended place will be dismantled and may thereby not be used for other purposes regarding the building.

U.S. Pat. No. 4,591,308 discloses another method for hoisting facade elements on a multi-storey building without the use of tower cranes. The patent discloses a guide jig for lifting facade elements. The guide jig is suspended from a rope and is guided in vertical rails provided on the outside of each facade element. When the facade element reaches the floor on which it is to be mounted the facade element is moved towards the building by the tower crane and a mechanical arm provided on the jig. A drawback with this method is that the facade element is not guided by the vertical rails on the previously mounted elements when the element reaches the floor on which it is to be mounted. Further, to move the facade element into its mounting position is complicated and involves a number of mounting steps.

GB22284009 discloses a method for mounting facade elements by means of a working elevator. The facade elements are provided with grooves, along which the working elevator is driven. The facade elements are transported to the floor where the facade elements will be installed by the working elevator. The working elevator is provided with its own drive. The working elevator includes a pneumatically controlled system for moving the facade elements towards the building and to its mounting position. Such a working elevator is complicated and accordingly expensive. If a plurality of columns of facade elements is to be mounted in parallel, it is necessary to have a plurality of working elevators, which is expensive.

OBJECTS AND SUMMARY OF THE INVENTION

The object of the present invention is to provide an improved method for mounting facade elements on a multi-storey building which alleviates the drawbacks mentioned above.

This object is achieved by the method as defined herein.

The method uses a profile system comprising a first type of vertical profile having a slot extending along the longitudinal axis of the profile, and an inner part of the slot being designed to receive an edge of a first facade element and an outer part of the slot is designed to receive and support a second type of vertical profile arranged to support the first facade element, and the second type of profile is provided with a groove extending along the longitudinal axis of the profile and designed to receive and support an edge of a second facade element. The method comprises:

a) mounting two vertical profiles of the first type at a second floor of the building so that the slots are facing each other, and above profiles of the first and second types previously mounted on a first floor so that the longitudinal axes of the profiles are aligned, b) transporting a facade element in a vertical direction guided by the grooves of the second type of profiles mounted on the first floor until it reaches the vertical profiles mounted on the second floor, c) entering the facade element into the outer part of the slots of the vertical profiles mounted on the second floor, d) continuing transporting the facade element in a vertical direction guided by the outer part of the slots of the vertical profiles mounted on the second floor until it reaches a mounting position, e) pushing the facade element from the outer part of the slots to the inner part of the slots, f) attaching the facade element to the building, such as a floor structure of the building, and g) inserting vertical profiles of the second type into the outer part of the slots so that the grooves are facing each other.

An advantage with the method according to the invention is that the facade element is supported all the way up to the mounting position and during the mounting of the facade element to the building. During transportation of the facade element to the floor below the present mounting position, the facade element is guided by the grooves of the second type of vertical elements, which also support the facade element mounted on the previous floor. When the facade element leaves the grooves on the floor below the present mounting position, the facade element is supported by the outer part of the slots of the vertical profiles mounted on the present floor during transportation as well as during mounting of the facade element. The outer part of the slots prevents the facade element from swinging away from the building due to windy weather. This enables a safe mounting not affected by bad weather conditions. Further, the method according to the invention enables safe mounting of large facade elements, in particular facade elements having a large width.

The method according to the invention is simple, fast, and accordingly reduces the time needed for mounting the facade elements, and accordingly considerably lowers the mounting costs.

The method further comprises: mounting two vertical profiles of the first type at a third floor of the building, so that the slots are facing each other, and above the profiles of the first and second type previously mounted on the second floor so that the longitudinal axes of the profiles are aligned, and transporting a second facade element, guided by the grooves of the second type of vertical profiles, in a vertical direction until it reaches the vertical profiles mounted on the third floor, and repeating the steps c-g for the second facade element. The facade elements are transported one by one on the outside of the previously mounted facade elements to the floor on which it is to be mounted. No on-floor staging is needed since the facade elements are trans-ported directly to the installation position, thereby reducing the used working space inside the building.

According to an embodiment of the invention, the second facade element is pushed from the outer part of the slots to the inner part of the slots by means of a tool. Such a tool can be made much cheaper than the previously mentioned pneumatically controlled system for moving the facade elements to its mounting position. As no expensive equipment is needed it is possible to simultaneously mount a plurality of facade elements on different horizontal positions along the building.

The method further comprises attaching a tool to at least one of said two vertical profiles on the second floor, and steps d and e further comprises moving the facade element upward until it comes into contact with the tool, moving the facade element upward to a position above the final mounting position, while the upward movement of the facade element affects the tool so that the tool is turned into a working position, and lowering the facade element towards the final mounting position causing the tool to push the facade element towards the inner part of the slots. The tool makes it possible to push the facade element to the final mounting position without having any person on the outside of the building. The personnel only has to mount the tool on the vertical profile from inside of the building, and to control the upward and downward vertical movements of the facade element, and the facade element will be pushed to its final mounting position by the mechanics contained within the tool.

According to an embodiment of the invention, the tool is driven by a vertical down movement of the facade element. Thus, the tool does not have to be provided with a drive of its own, which reduces the cost of the tool.

According to an embodiment of the invention, the vertical profiles of the first type are provided with a first fastening element designed to be engaged to a corresponding fastening member on the building, and a second fastening element designed to be engaged to a corresponding fastening unit provided on the facade element, and step a further comprises: providing the second floor with at least two fastening members arranged at a distance from each other, and attaching the vertical profiles of the first type to the second floor by engaging the first fastening elements to the fastening member on the second floor, and step f comprises attaching the facade element to the building by engaging the fastening units of the facade element to the second fastening elements of the vertical profiles. Preferably, the fastening elements are attached beforehand to the vertical profiles.

This embodiment simplifies the mounting of the facade element in that the second fastening element is already mounted to the vertical profiles, and does not have to be mounted to the floor of the building. Accordingly, the step of mounting fastening elements to the building is omitted. However, if the facade element is very wide it is possible to provide one or more extra fastening elements of a different type on the floor between the vertical elements and corresponding fastening units on the facade element to support the middle part of the facade element. Further, the positioning of the facade element with respect to the building is facilitated, as the vertical profiles have a defined position with respect to the building when the first fastening elements are engaged to the fastening members of the building, and the facade element has a defined position with respect to the vertical profiles when the second fastening elements are engaged to the fastening units on the facade element.

According to an embodiment of the invention, the first and second fastening elements are integrated in a single unit and comprise a common load bearing body. This embodiment facilitates the mounting of the fastening elements to the vertical profile. Further, the common load bearing body transfers the weight of the facade element to the fastening member on the building, and thus of the weight of the facade element is carried by the building, and not by the vertical profile.

According to an embodiment of the invention, the facade elements are delivered to the building by a truck trailer, and the method comprises automatically moving the facade elements from the truck trailer to a storage position located at a base of the building. Further, the method comprises transporting the facade elements from the storage position to a desired horizontal position by means of a conveyer system including a track arranged around at least a part of the building. On-site transport will be minimized by lifting the facade elements directly from the truck trailer and forwarding them to their installation position, without any interim on-floor staging. This avoids internal transportations. Further, the risk of damaging the facade elements is reduced since no on-ground or on-floor staging is necessary and because there is full control over the transports of the facade elements.

According to an embodiment of the invention, the facade elements are vertically moved by means of a lifting device, for example a mini crane, positioned on the floor at which the facade element is to be mounted or on a floor above the floor at which the facade element is to be mounted. A general multi-purpose lifting device can be used for vertical movements of the facade element. Thus, no specially designed drive unit is needed for the vertical movements of the facade element.

According to an embodiment of the invention, the facade elements are moved by means of an elevator unit provided with a gripping device for gripping the facade element, the gripping device being arranged to move the facade element so that the edges of the facade element are aligned with the grooves of the second type of vertical profiles mounted on the building thereby facilitating the insertion of the facade element into the grooves of the second type of vertical profiles, and the method comprises gripping the facade elements by means of the elevator unit, and inserting the second facade element into the grooves of the second type of vertical profiles by means of the elevator unit. Accordingly, the insertion of the facade element into the grooves of the second type of vertical profiles can be made automatically, and can be controlled by a worker standing at a distance from the insertion position, for instance at the foot of the building.

Further, the elevator unit is guided by the grooves of the second type of vertical profiles, and the elevator is vertically moved by the lifting device. Thus, the elevator does not need to have any drive system of its own. A general multi-purpose lifting device can be used.

According to an embodiment of the invention, the method comprises transporting the facade elements from the storage position to the elevator unit by means of the conveyer system. A flow of facade elements from delivery by the truck to installation is provided and a continuous flow of facade elements from delivery to installation is enabled. Thereby, contractors will not be subject to unnecessary handling of the facade elements, or have to wait for tower cranes or other trades. This means that the facade contractor is virtually independent of the site's common shared cranes and building hoists.

According to an embodiment of the invention, a correct distance between the two vertical profiles of the first type during mounting of the profiles is ensured by means of a jig having a length that corresponds to the width of a facade element. This embodiment makes it quick and easy to mount the vertical profiles with a correct distance between them.

According to an embodiment of the invention, said first type of vertical profile has a second slot extending along the longitudinal axis of the profile on an opposite side of the profile with respect to the first mentioned slot, and the second slot has an inner part designed to receive an edge of a facade element and an outer part designed to receive the second type of vertical profile, and the method comprises mounting one vertical profile of the first type at a horizontal distance from one of the profiles of the second floor so that the slots are facing each other, and above one profile previously mounted on a first floor so that the longitudinal axes of the profiles are aligned, and repeating the steps b-g. One vertical profile of the first type can be used for mounting two horizontally aligned facade elements, which facilitates the mounting.

According to an embodiment of the invention, the method further comprises mounting a adaptor block on top of the vertical profiles of the first and second type and between two aligned facade elements, mounting a continuous sealing strip on top of two horizontally aligned facade elements and on top of the adaptor block in order to seal between facade elements and vertical profiles of different floors, and thereafter mounting the facade elements on the next floor above the sealing strip. The sealing strip extends continuously over a plurality of facade elements and vertical profiles. This embodiment ensures a safe horizontal sealing between the facade elements.

BRIEF DESCRIPTION OF THE DRAWINGS

The invention will now be explained more closely by the description of different embodiments of the invention and with reference to the appended figures.

DETAILED DESCRIPTION OF PREFERRED EMBODIMENTS OF THE INVENTION

Figure 1:
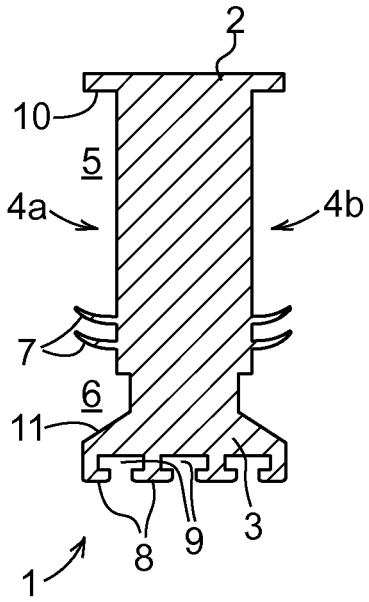
FIG. 1 shows a cross-sectional view of an example of a vertical profile of a first type.
Figure 3:
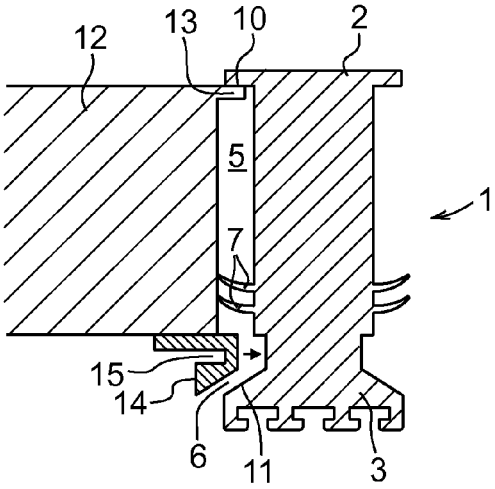
FIG. 3 shows a cross-sectional view of the facade element when it has been moved to an inner part of the slot, and a vertical profile of a second type.

FIG. 1 shows a cross-section through an example of a vertical profile 1 of a first type. The vertical profile 1 has a cross-section, which is essentially constant along the length axis of the profile. The vertical profiles 1 are of corresponding lengths to the facade element. The profile 1 comprises a first portion 2, which is arranged to be placed facing the building, and a second portion 3, which is arranged to be placed facing away from the building. A slot 4*a-b* is arranged between the first and second portion on each side of the vertical profile 1. The slots 4*a-b* extend along the longitudinal axis of the profile 1. Each of the slots is divided into an inner part 5 and an outer part 6. The inner part 5 of the slot is designed to receive and house an edge part of a facade element, and the outer part 6 of the slot is designed to receive and support a second type of vertical profile 14, as shown in FIG. 3. The edge part can also be an adapter provided on the edges of the facade element in order to adapt it to the profile system. The inner part 5 of the slot is provided with a plurality of flexible elements 7. The flexible elements 7 are made of a resilient material and are arranged to support, centre, and seal the facade element when it is mounted, as shown in FIG. 3.

The second portion 3 comprises an outer surface on which there is arranged a plurality of supporting profiles 8, which extend along the longitudinal axis of the profile 1, and between which notches 9 are arranged. The supporting profiles 8 may be used to guide one or more supporting devices. The first portion 2 comprises an inner surface 10 facing the inner part 5 of the slot, and the second portion 3 comprises an inner surface 11 facing the outer part 6 of the slot. The vertical profile 1 is symmetrical with respect to a symmetry axis that extends through the first and second portions 2, 3. The vertical profile 1 can have different designs. Another example of a vertical profile of the first type suitable for mounting by means of the method according to the invention is disclosed in WO2009/093948. In this example, the edges of the facade element does not have a protruding part, instead the whole edge of the facade element is entered into the slot.

Figure 2:
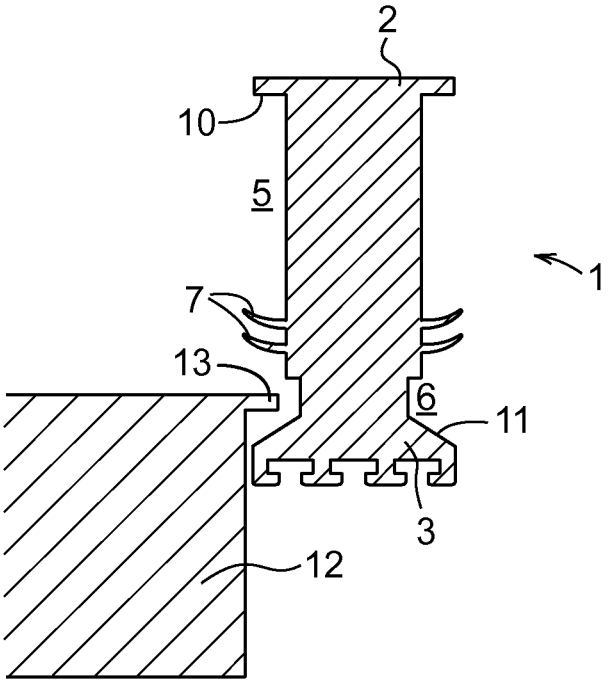
FIG. 2 shows a cross-sectional view of an example of a facade element guided by an outer part of a slot in the vertical profile shown in FIG. 1

FIG. 2 shows a cross-sectional view of a part of a facade element 12 supported by the outer part 6 of the slot in the vertical profile 1. FIG. 2 is a cross-section A-A through the mounting shown in FIG. 6. The facade elements may comprise glass plates, or laminated glass, one or more weatherproof plates or a combination of glass plates and weatherproof plates and may also comprise a frame which holds the glass plates and/or the weatherproof plates. A combination of different plate formed facade elements may be used for the facade. The edge of the facade element 12 is provided with a protruding part 13 extending along the entire length of the facade element. The protruding part 13 of the edge of the facade element is located in the outer part of the slot 6. The opposite edge of the facade element is provided with a corresponding protruding part (not shown), which is located in the outer part of the slot of another vertical element of the first type arranged at a distance from the first vertical element. Accordingly, the facade element 12 is supported by the outer parts 6 of the slots and the facade element is thereby prevented from swinging away from the building.

FIG. 3 shows the facade element 12 when it has been moved from the outer part 6 to the inner part 5 of the slot of the vertical profile 1. The protruding part 13 of the edge of the facade element is bearing on the surface 10 of the first portion 2. The flexible members 7 support the facade element 12. FIG. 3 also shows a vertical profile 14 of a second type, which is designed to fit in the outer part 6 of the slot, and arranged to support the facade element 12 when it has been mounted. The vertical profile 14 of the second type is named a U-profile. The vertical profile 14 of the second type is provided with a groove 15 extending along the longitudinal axis of the profile and designed to receive and support the protruding edge part 13 of a facade element. The groove 15 is named a U-groove. The vertical profile 14 has a cross-section, which is essentially constant along the length axis of the profile. The length of the vertical profile 14 of the second type is essentially the same as the length of the vertical profile 1 of the first type. The profile 14 of the second type is arranged to be placed so that it supports the first facade element 12. The profile 14 is designed to bear on the surface 11 of the second portion 3 on the profile 1 when it is mounted, as shown in FIG. 4.

Figure 4:
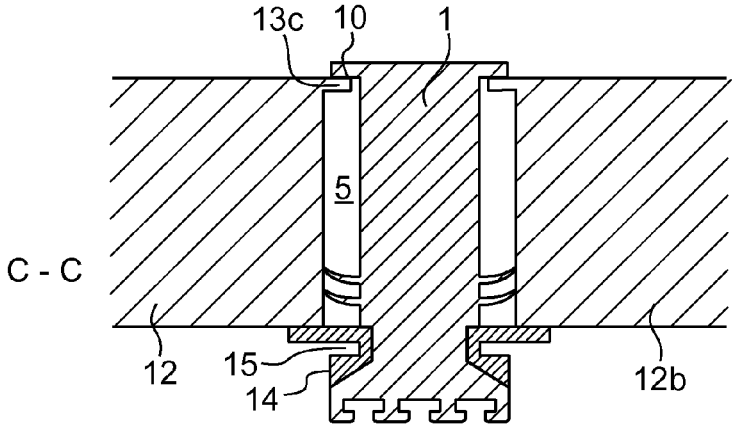
FIG. 4 shows a cross-sectional view of two facade elements held by the vertical profile of the first type and supported by vertical profiles of the second type.

FIG. 4 shows a cross-section through two facade elements 12,12*b* mounted by the method according to the invention. The facade elements are positioned in their final mounting position.

The two facade elements 12,12*b* are horizontally aligned and supported by the vertical profile 1 of the first type 1 and two vertical profiles 14 of the second type. FIG. 4 is a cross-section C-C through the mounting shown in FIG. 6.

Figure 5:
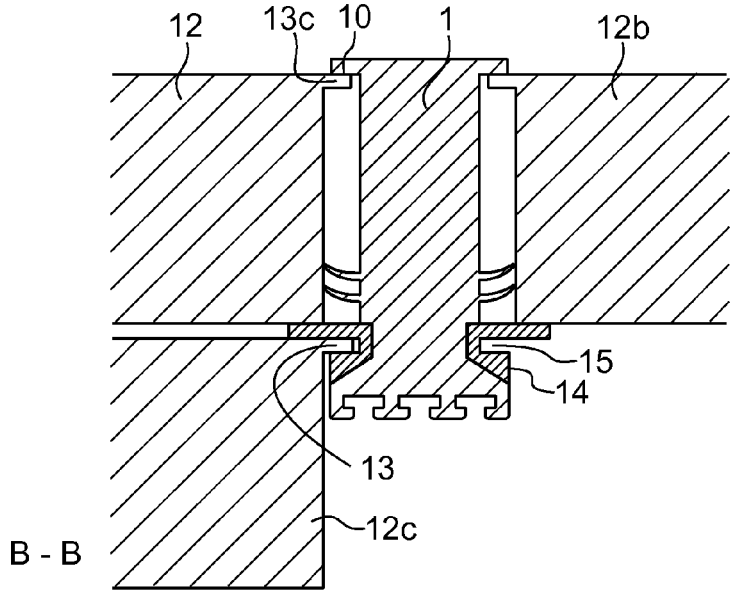
FIG. 5 shows a cross-sectional view of a facade element guided by a groove in the vertical profile of the second type.

FIG. 5 shows a cross-section through a facade element 12*c*, which is on its way to its mounting position. The facade element 12*c* is guided by the groove 15 of the vertical profile 14 of the second type when it is vertically moved. The facade elements 12,12*b* are already mounted at their final position. The facade element 12*c* is vertically moved to its mounting position on the outside of the facade elements 12,12*b* The other edge of the facade element (not shown) is also provided with a protruding part 13, which is guided by a corresponding groove 15 in a vertical profile 14 of the second type arranged in a profile 1 of the first type in the same way as shown in FIG. 5. FIG. 5 is a cross-section B-B through the mounting shown in FIG. 6.

Figure 6:
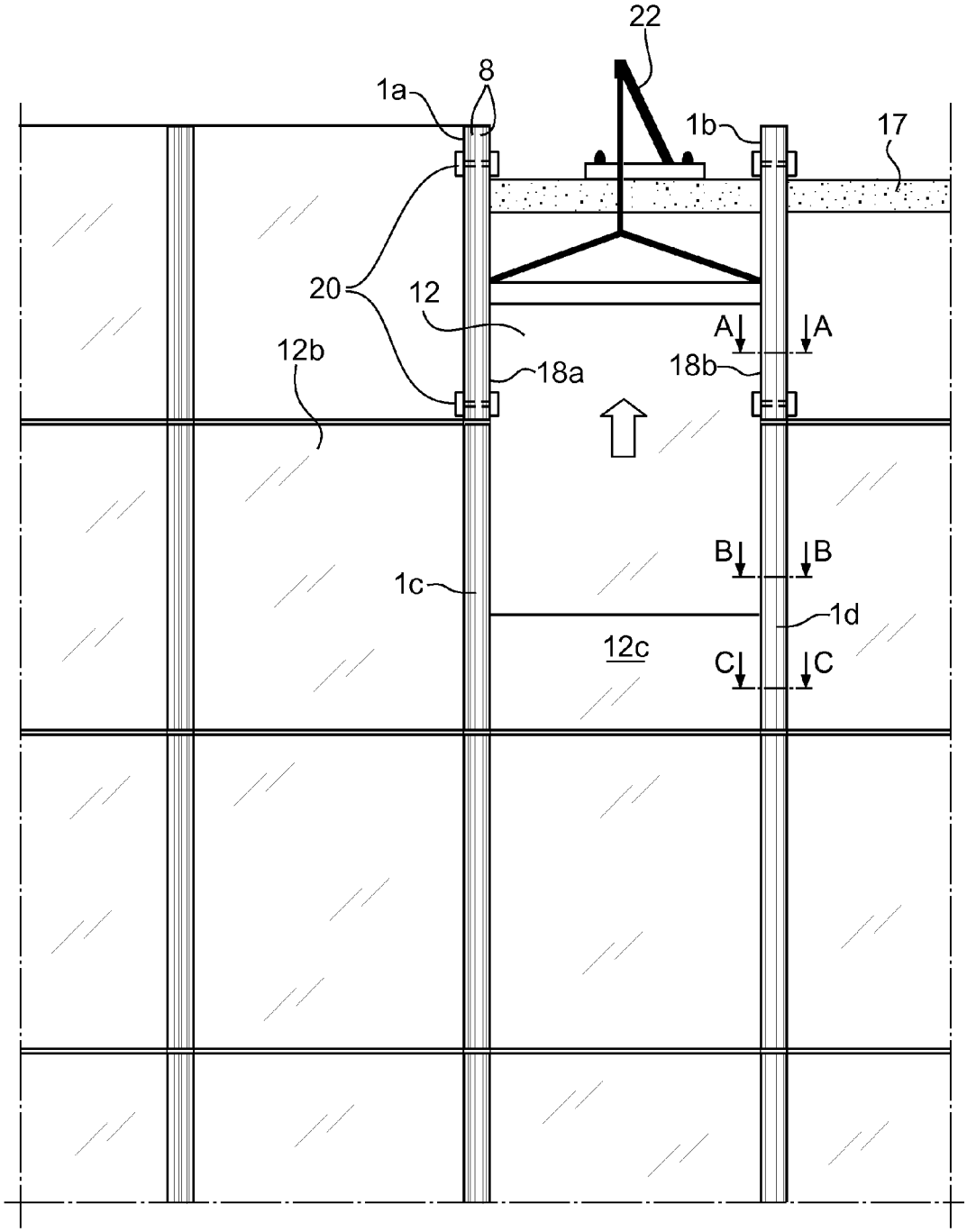
FIG. 6 shows a elevational view of a part of multi-storey building on which facade elements are mounted with a method according to the invention.

FIG. 6 shows an elevational view of a part of a multi-store building on which facade elements are mounted with a method according to the invention. Further, the figure illustrates transportation of a facade element 12 during mounting of the facade. The building comprises a number of vertical, load-bearing walls (not shown) as well as a number of horizontal, between the walls extending floors 17, also denoted slabs. The facade element 12 comprises a first main side and a second main side, which are essentially parallel to each other. The facade element also comprises a first edge 18*a* and a second edge 18*b*. Each of the edges 18*a-b* includes a protruding part 13. A plurality of horizontally aligned facade elements is mounted on one floor.

A number of vertical profiles 1*a-d* of the first type is attached to the floors of the building. The vertical profiles are arranged above each other so that the longitudinal axes of the profiles are aligned, thereby forming columns of vertical profiles. A plurality of columns of vertical profiles is arranged in parallel and at a horizontal distance from each other which essentially correspond to the width of the facade elements. Two neighbouring columns of vertical elements 1 are arranged so that the slots are facing each other. Facade elements 12*b-c* are mounted between two neighbouring columns of profiles. FIG. 4 shows a cross section C-C through the mounted facade elements and the vertical profiles. The mounted facade elements are supported by vertical profiles 14 of the second type, as shown in FIG. 4, which have been entered into the outer parts 6 of the slots of the vertical profiles 1 of the first type. The vertical profiles of the first and second type are mounted so that they are allowed to receive the facade element from below and to support the edges of the facade element when the facade element is transported to the mounting position. Supporting profiles 8 extend along the length of the vertical profiles of the first type.

When a facade element 12 is to be transported to its mounting position, the protruding parts 13 of the edges 18*a-b* of the facade element are inserted into the grooves 15 of the lowest vertical profiles of the second type of two neighbouring columns of vertical profiles. The facade element 12 is vertically moved to the mounting position guided by the grooves 15 of the vertical profiles of the second type previously mounted on the floors below the floor of the mounting position. FIG. 5 shows a cross section B-B through the facade element 12 when it is guided by the grooves 15 of the vertical profile of the second type.

When the facade element reaches the vertical profiles 1*a*, 1*b* mounted on the floor at which the facade element is to be mounted, the protruding parts 13 of the edges 18*a-b* of the facade element 12 are inserted into the outer parts 6 of the slots of the profiles 1 and 1*b*, as shown in FIG. 2. FIG. 2 is a cross section A-A through the facade element 12 and the vertical profile 1. The facade element 12 is moved guided by the outer parts 6 of the slots in a vertical direction towards the mounting position. In this embodiment, a tool 20 is mounted on each of the two neighbouring vertical profiles 1 and 1*b* on the last floor where the facade is being mounted. The tool 20 is used for pushing the facade element 12 from the outer part 6 of the slots to the inner parts 5 of the slots. The tools 20 are arranged in the supporting profiles 8 that extend along the length of the vertical profiles 1*a*, 1*b*, and the tool is allowed to move along the notches 9 between the supporting profiles. The facade element 12 is vertically moved by means of a lifting device 22 positioned on the floor at which the facade element is to be mounted or on a floor above the floor at which the facade element is to be mounted. The lifting device is, for example, a mini crane.

Figure 7:
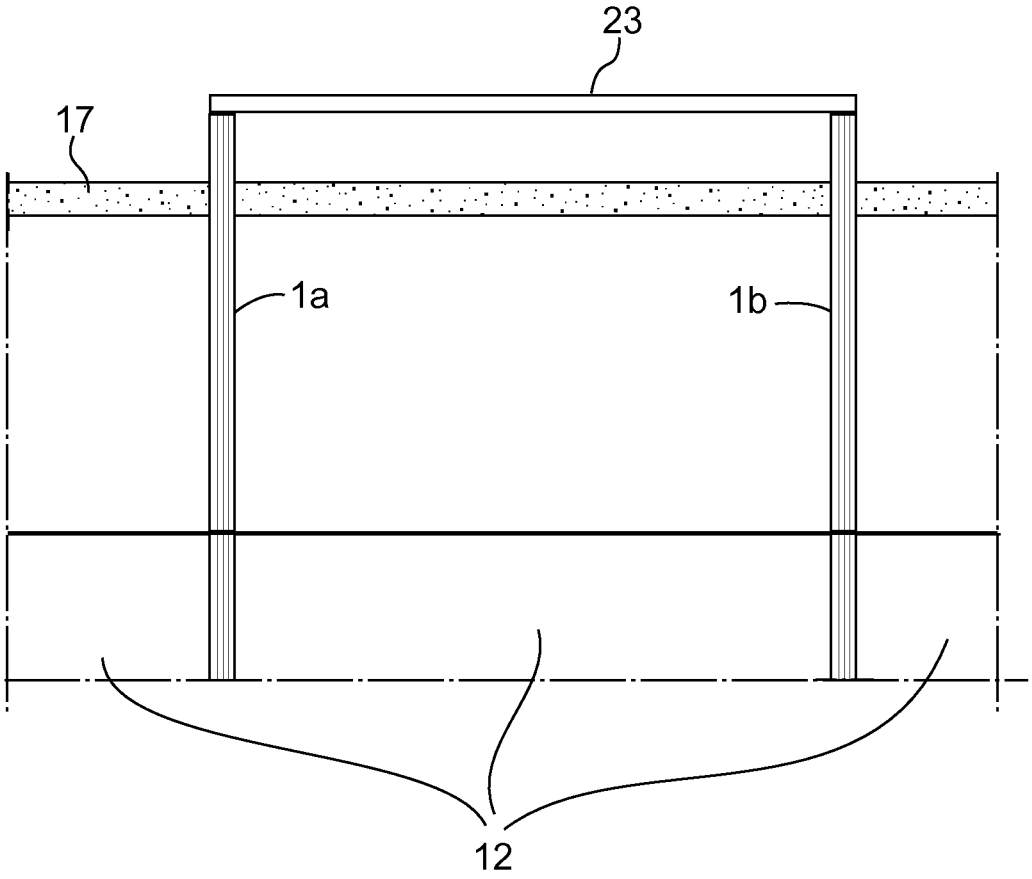
FIG. 7 illustrates how a correct distance between two vertical profiles of the first type is ensured by means of a jig.

FIG. 7 illustrates how a correct distance between two vertical profiles of the first type 1*a-b* is ensured by means of a jig 23 having a length that corresponds to the length of the facade element to be mounted. The jig 23 has the form of a bar. By using the jig a correct distance and parallelism between the two vertical profiles 1*a-b* is ensured. When the vertical profile has been mounted the jig is removed and can be used for mounting the next vertical profile 1. The jig is arranged to be engaged to the upper parts of two vertical profiles arranged at a distance from each other. The jig 23 is provided with one or more holes in each of its ends having a size that corresponds to the size of the protruding pins 27 of the vertical elements. When the jig is used, the holes on one of the ends of the jig are threaded on the pins of an already mounted vertical element 1*a* and the holes on the other end of the jig is thread on the vertical profile 1*b*, which is to be mounted.

Now an inventive method for fastening the vertical profiles 1 of the first type and the facade elements 12 to the building will be described with reference to the FIGS. 8*a-c*, 9*a-b* and 10.

Figure 8A:
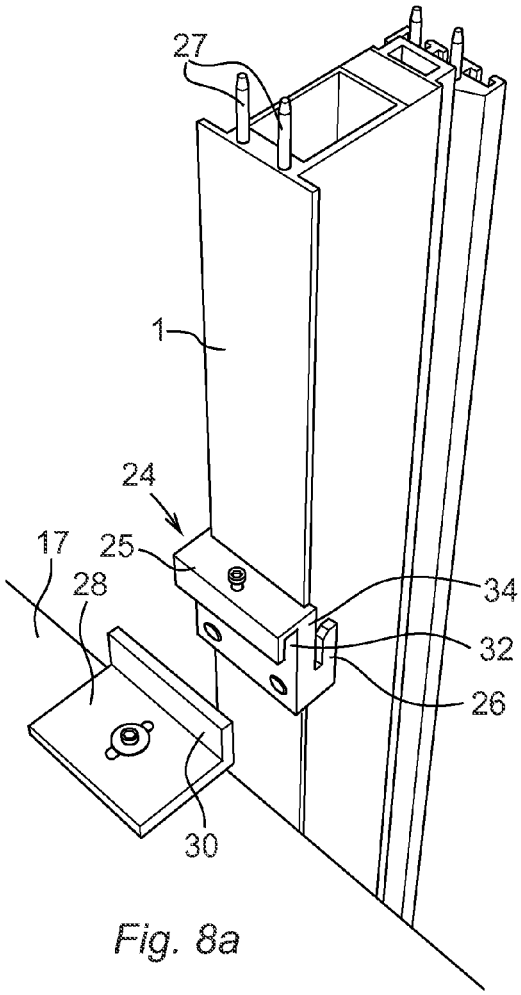
FIG. 8*a* shows a perspective view of a vertical profile of the first type provided with a fastening device and a floor of a building provided with a fastening member.

FIG. 8*a* shows a perspective view of a vertical profile 1 of the first type provided with a fastening device 24 comprising a first fastening element 25 for fastening to the fastening member 28 on the building, and a second fastening element 26 for fastening the facade element. Preferably, the fastening device 24 is preassembled to the vertical profile 1 before delivery to the building site. The fastening device 24 is shown in a view from behind in FIG. 8*c*. In this embodiment, the fastening device 24 is provided with two second fastening elements 26 for fastening two facade elements, which are mounted on opposite sides of the vertical profile 1 to the building. For fastening the facade element 12 to the building at least two second fastening elements 26 are needed; one for each edge 18*a-b*. The fastening device 24 comprises a common load-bearing body 34 and the first and second fastening elements 25, 26 are provided on the load-bearing body.

Figure 8B:
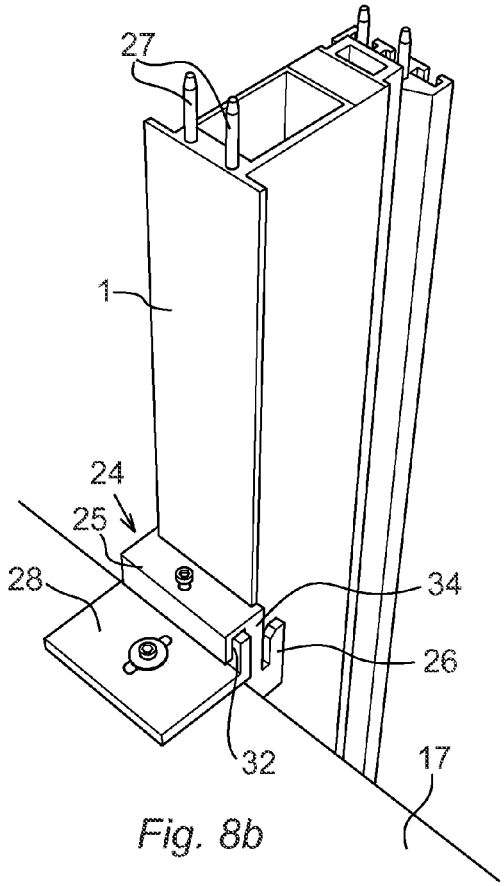
FIG. 8*b* shows a perspective view of a vertical profile of the first type fastened to the floor of a building by means of the fastening device and the fastening member.
Figure 8C:
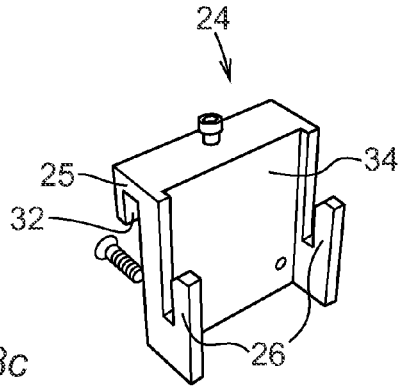
FIG. 8*c* shows a perspective view of the fastening device.
Figure 19:
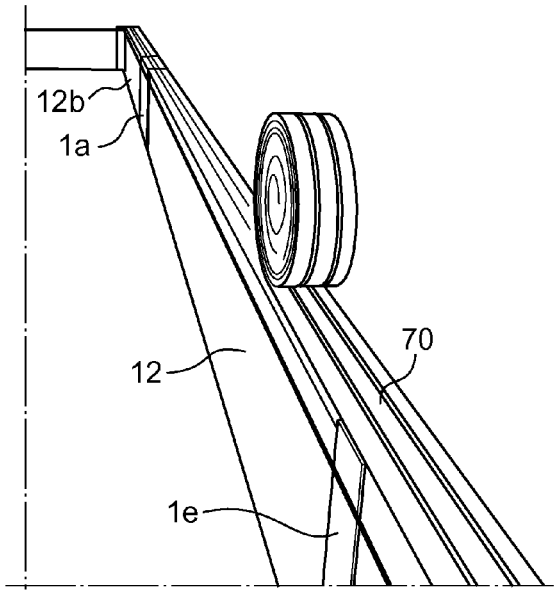

The upper part of the vertical profile 1 is provided with protruding pins 27 adapted to be inserted in corresponding holes provided on the lower part of the next vertical profile to be mounted above the vertical profile. The figure further shows a floor 17 of the building. On the floor 17 is mounted a fastening member 28 adapted to be engaged to the first fastening element 25 on the vertical profile 1. The fastening member 28 comprises a vertically extending portion 30, and the first fastening element 25 comprises a slot 32 designed to receive the portion 30 of the fastening member 28 thereby providing an engagement between the first fastening member 28 and the first fastening device 24. During mounting of the vertical profile 1, the first fastening element 25 is engaged to the vertically extending portion 30 of the fastening member 28, as shown in FIG. 8*b*. The first fastening element 25 is then clamped to the portion 30 of the fastening member 28. As shown in FIGS. 8*a-b* and FIG. 6 the vertical profiles are mounted so that they extend a distance above the floor to which they are mounted, which, for example, facilitates mounting of the sealing strip as described with reference to FIG. 19. However, in an alternative embodiment of the invention, the joint can be align with the floor.

Figure 9A:
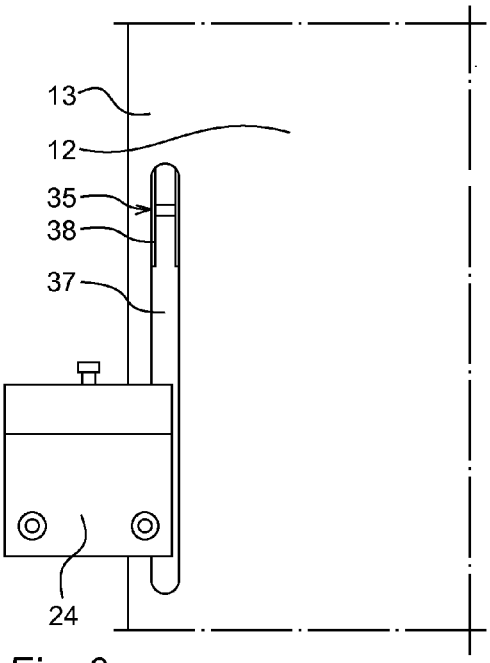
FIG. 9*a* shows a side view of a facade element provided with a fastening unit and a fastening device.
Figure 9B:
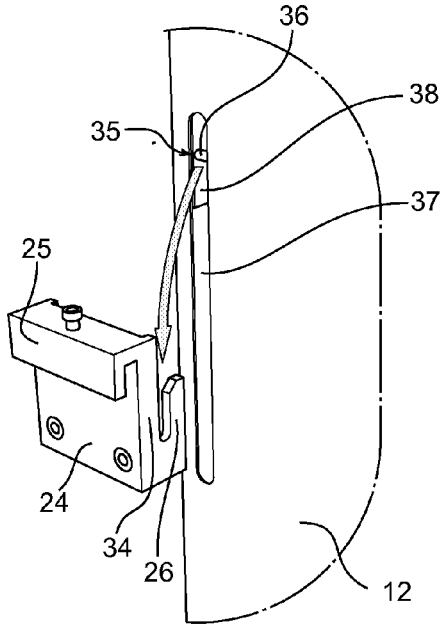
FIG. 9*b* shows an elevational view of the facade element provided with a fastening unit and the fastening device.

FIG. 9*a* shows a rear elevational view of a facade element 12 provided with a fastening unit 35, for attaching the facade element to the second fastening element 26 and thereby to the building. FIG. 9*b* shows a perspective view of the facade element 12 and the fastening device 24. In this embodiment the fastening unit 35 includes a pin 36 provided in a recess 37 of the edge of the facade element 12. The upper part of the recess 37 is provided with a metal plate 38 to reinforce the recess. The facade element 12 is provided with one fastening unit 35 in each of its edges 18*a-b*. The second fastening element 26 is designed to be engaged to the fastening unit 35 provided on the facade element. In this embodiment, the second fastening element 26 is designed as a hook adapted to receive the pin 36 of the fastening unit 35. During mounting of the facade element 12, the fastening units 35 on each side of the facade element are engaged to the second fastening elements 26 of the fastening devices 24, which has been engaged to the floor when the vertical profiles 1*a*, 1*b* were previously mounted. By that the facade element is attached to the floor of the building.

Figure 10:
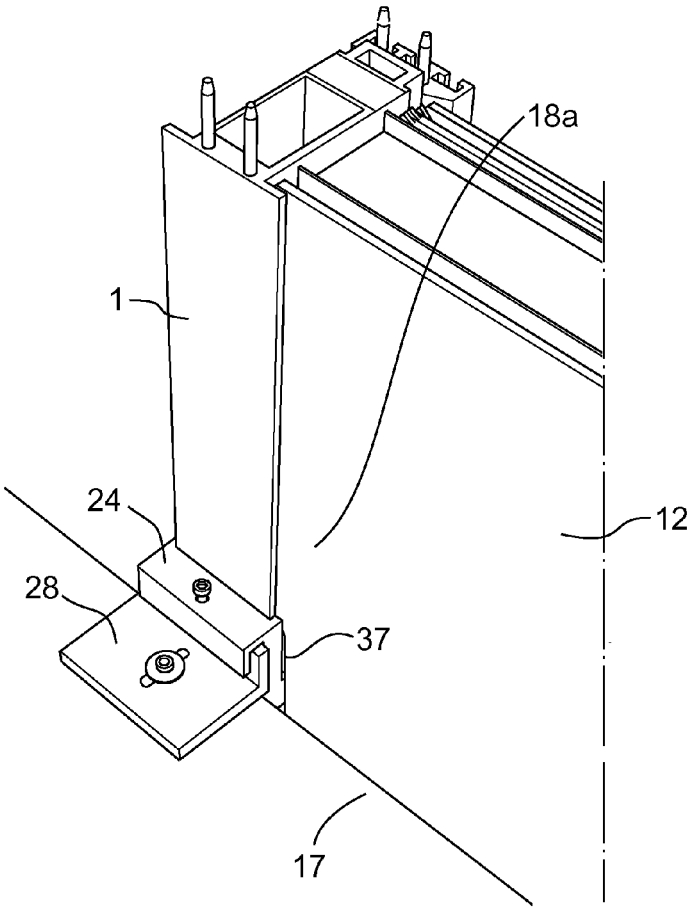
FIG. 10 shows a perspective view of a facade element and a vertical profile of the first type attached to the floor of the building by means of a fastening device.

FIG. 10 shows one edge 18*a* of the facade element attached to the floor 17 of the building by means of the fastening device 24 and the fastening member 28. The other opposite edge 18*b* of the facade element is attached to the floor 17 of the building in the same way as shown in FIG. 10 by means of a fastening device, a fastening member, and fastening unit.

Figure 11:
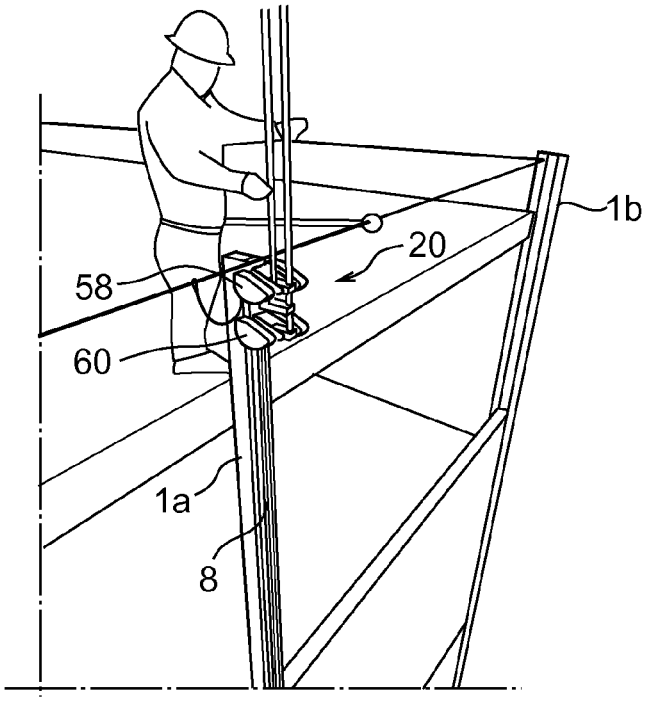
FIGS. 11-12 illustrate mounting of a tool for pushing the facade element from the outer part of the slot to the inner part of the slot of the vertical profile of the first type.
Figure 12:
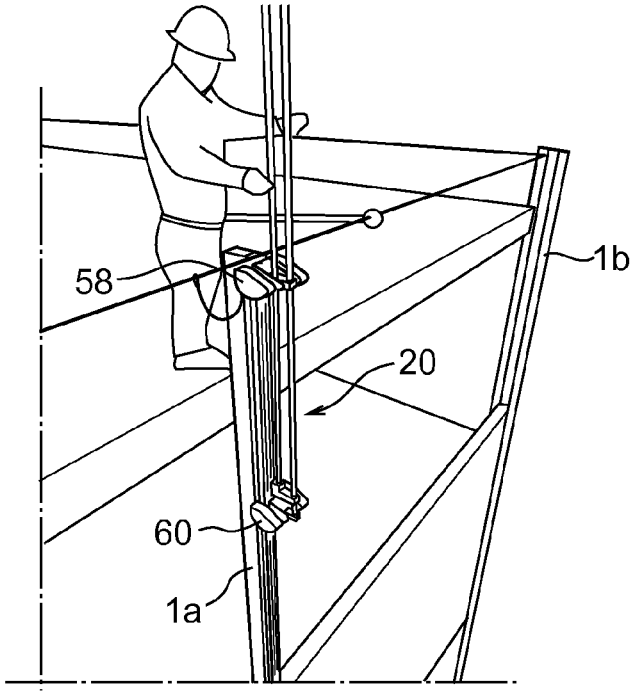

FIGS. 11 and 12 illustrate mounting of a tool for pushing the facade element from the outer part of the slot to the inner part of the slot of the vertical profile of the first type. When the facade element has reached its mounting position, or close to the mounting position, the facade element must be moved from the outer part 6 to the inner part 5 of the slots. A press power is needed in order to overcome the resistance due to friction from the flexible elements 7 on the vertical profile 1.

Figure 17A:
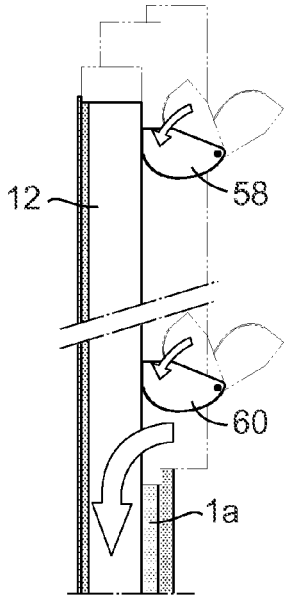
Figure 17B:
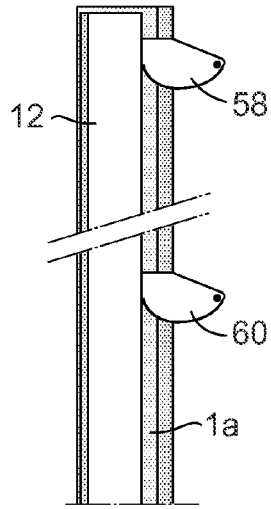

According to an embodiment of the invention, a specially designed tool is used for performing this step. This can, for example, be done by a tool 20 including one or more eccentrically supported discs 58,60 arranged at a vertical distance from each other, as shown in FIGS. 11 and 12. In alternative embodiments of the invention, the tool 20 may have only one disc, or more than two discs. The discs are shaped so that the difference between the minimum and maximum radius of the disc corresponds to the horizontal movement that is required for pushing the facade element from the outer part 6 of the slot to the inner part 5 of the slot. At the maximum radius of the disc, the disc is provided with a plane surface adapted to bear on the facade element. The plane surface of the disc is covered with a low friction material, and the curved surface is covered with a high friction material. The angular movement of the disc is stopped when the plane surface of the disc is in parallel with the facade element, as shown in FIG. 17*b*. The discs are designed so that the discs rotate due to friction when they are in contact with the facade element when the facade element is moved downwards. The facade element is moved downwards due to its own weight when the gravity force is acting on the element. Accordingly, the dead weight of the facade element is used to achieve the press power needed to move the facade element from the outer to the inner part of the slots.

The tool disclosed in FIGS. 11 and 12 is provided with two pair of discs 58,60 adapted to be arranged on opposite sides of the vertical element 1 in order to act on facade elements on both sides of the vertical element. This reduces the number of times the tool has to be moved. When a facade element has been mounted, only one of the tools has to be moved to the mounting position of the next facade element to be mounted. The angular positions of the discs are synchronized by means of a transmission (not shown), for example chain or a synchronous transmission belt.

FIG. 11 illustrates how the tool 20 is inserted into the groove 9 of one or more of the supporting profiles 8 of the vertical profile 1 of the first type, which has been mounted on the building. FIG. 12 illustrates how one pair of discs 60 is moved downward in the supporting profile 8 until it reaches the lower part of the vertical profile 1. The other pair of discs 58 is positioned at the upper part of the vertical profile 1. One tool 20 is mounted on each of the two vertical profiles arranged neighbouring each other for supporting the facade element.

Figure 13:
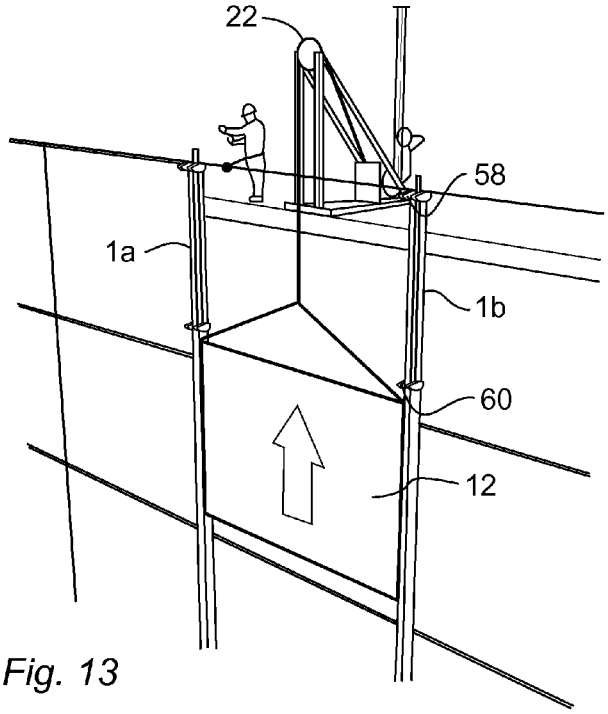
FIGS. 13, 14, 15*a-b*, 16*a-b*, and 17*a-b* illustrate mounting of a facade element by means of the tool.
Figure 15A:
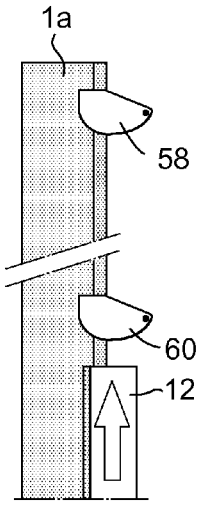
Figure 14:
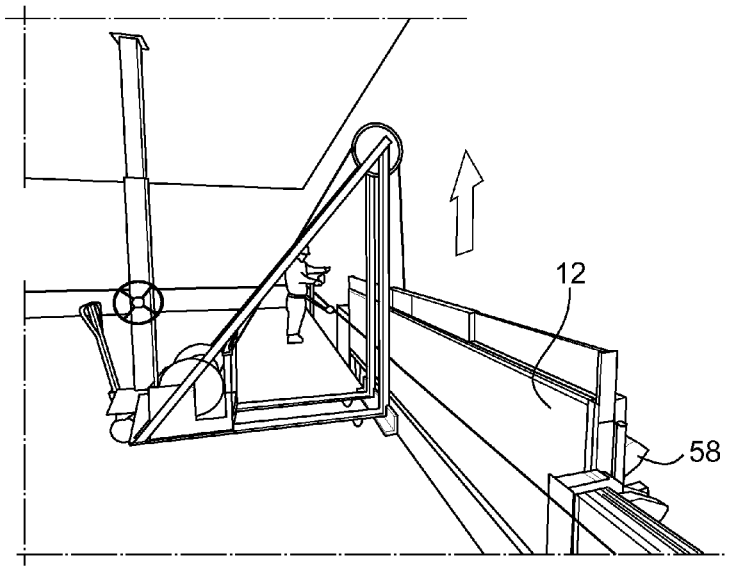
Figure 15B:
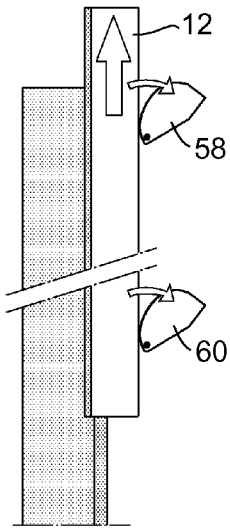

In the following, the mounting of the facade element will be explained with reference to the FIGS. 13, 14, 15*a-b*, 16*a-b*, 17*a-b*. The facade element 12 is moved upward until it comes into contact with the lower discs 60 of the tools, as shown in FIG. 13 and FIG. 15*a*. When the facade element 12 comes into contact with the lower disc 60, the facade element 12 will turn away the discs 60 and 58 so that the contact between the facade element and the discs are made where the discs have their smallest radius, and accordingly the facade element 12 without hindrance can pass by the discs 58, 60, whose surfaces slide against the facade element, as shown in FIG. 15*b*. Thus, the upward movement of the facade element affects the discs 58, 60 so that the discs are turned into a working position, i.e. the discs are rotated until they reach their smallest radius, as shown in FIG. 15*b*. The facade element 12 is further moved upward to a position above the final mounting position, as shown in FIG. 14.

Figure 16A:
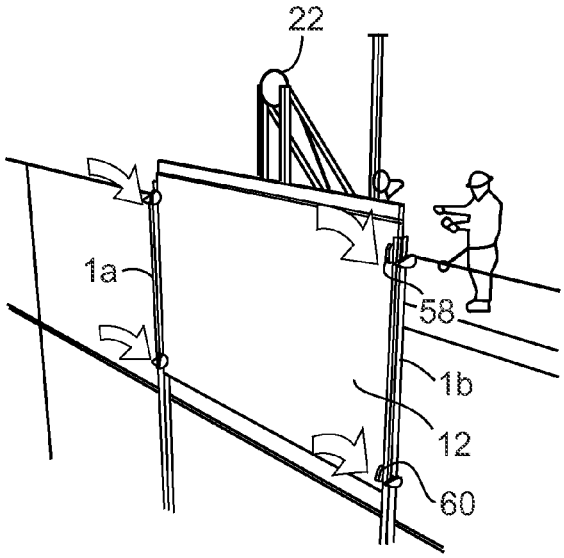
Figure 16B:
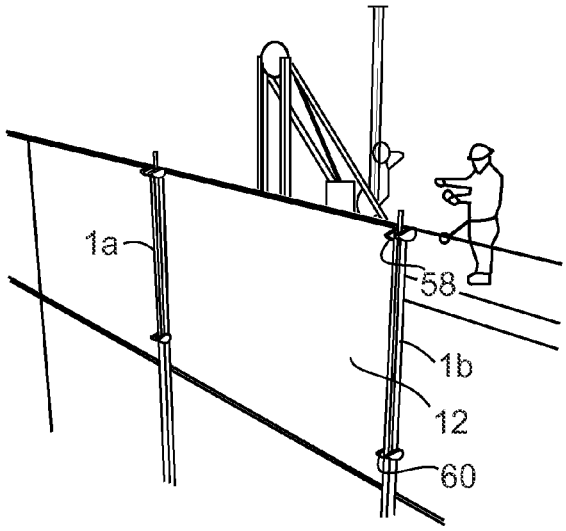

Thereafter, the facade element 12 is lowered towards the final mounting position, as shown in FIG. 16*a*, and at the same time the discs 58,60 are driven to push the facade element towards the inner part of the slots. When the facade element is moved downwards towards the final mounting position, the discs 58, 60 are caused to rotate to their largest radius by the movement of the facade element, as shown in FIG. 17*a*. When they are rotated, the discs push the facade element towards the inner part of the slot. During the downward movement, the discs are rotated until they reach their largest radius. When the discs have reached their largest radius the facade element 12 is close to the final mounting position, and the facade element is vertically moved, as shown in FIG. 17*a-b*, until the fastening units 35 on the facade element are engaged to the second fastening elements 26 on the vertical profiles 1*a-b* and thereby the facade element is attached to the floor of the building, as shown in FIG. 9*b*, 10, and 16*b*. The facade element 12 is now positioned in the inner parts 5 of the slot and engaged to the fastening elements 26 of the vertical profiles 1*a-b* of the first type. The discs 58, 60 have released contact with the facade element and the tool can be removed from the vertical profile 1.

The next step is to insert vertical profiles of the second type 14 into the outer parts 6 of the slots of the two vertical profiles supporting the facade element, as shown in FIGS. 3 and 4. The profiles 14 of the second types are secured by ropes attached to the upper ends of the profiles 14. The profiles 14 are lowered along the vertical profiles 1*a-b* of the first type until they are positioned at a determined horizontal position close to the mounting position. Thereafter, the profiles 14 are inserted into the outer parts 6 of the slot of the vertical profiles 1*a-b* so that the vertical profile 14 is bearing on the surface of facade element 12 and the surface 11 of the outer part 6 of the slot. The profile 14 is attached to the profile 1, for example, by means of a screw-joint or a snap-fit joint. The mounting of the vertical profile 14 of the second type can preferably be made by using a specially designed mounting tool.

Figure 18A:
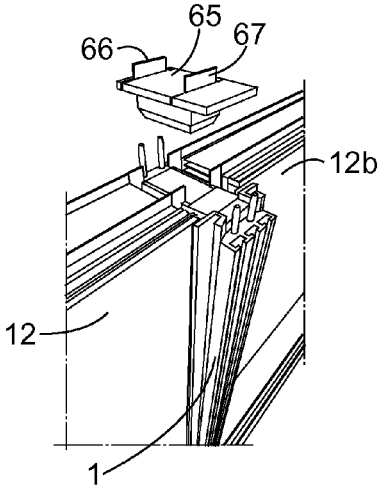
FIGS. 18*a-c* and 19 illustrate the steps of providing a seal between the facade elements.
Figure 18B:
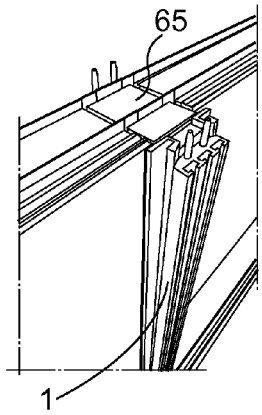
Figure 18C:
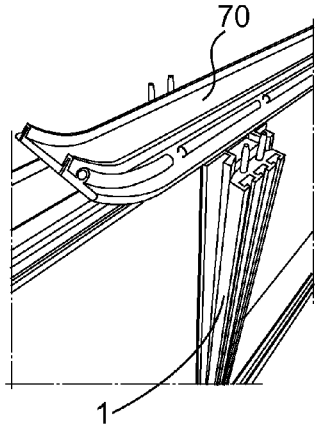

FIGS. 18*a-c* and 19 illustrate the steps of providing a horizontal sealing between the facade elements on different floors. When all facade elements on a floor have been mounted, a continuous sealing strip 70 is provided on top of the facade elements and the vertical profiles. Before the sealing strip 70 can be mounted a adaptor block 65 is mounted on the top each of the vertical profiles of the first type 1 on the floor. The adaptor block 65 is designed to fit between the facade elements 12, 12*b* on each side of the vertical profile 1 and to achieve a support for the seal 70 where it is not supported by the upper edge of facade element. The upper side of the adaptor block 65 has a profile that corresponds to the upper side of facade element. In this embodiment, the adaptor block 65 is provided with two parallel guiding rails 66, 67 adapted to support and guide the sealing strip 70. FIG. 18*a* shows the adaptor block 65 before mounting and FIG. 18*b* shows the adaptor block when it is mounted to the top of the vertical profile 1. FIG. 18*c* shows the mounting of the sealing strip 70. When all the vertical profiles 1 on the floor have been provided with adaptor blocks 65, the sealing strip 70 is rolled out in one piece on top of the horizontally aligned facade elements and the vertical profiles on the floor in order to seal between facade elements and vertical profiles of different floors. The sealing strip is for example a rubber extruded strip. When the sealing strip has been mounted, vertical elements and facade elements are mounted on the next floor according to the method previously described.

Figure 20:
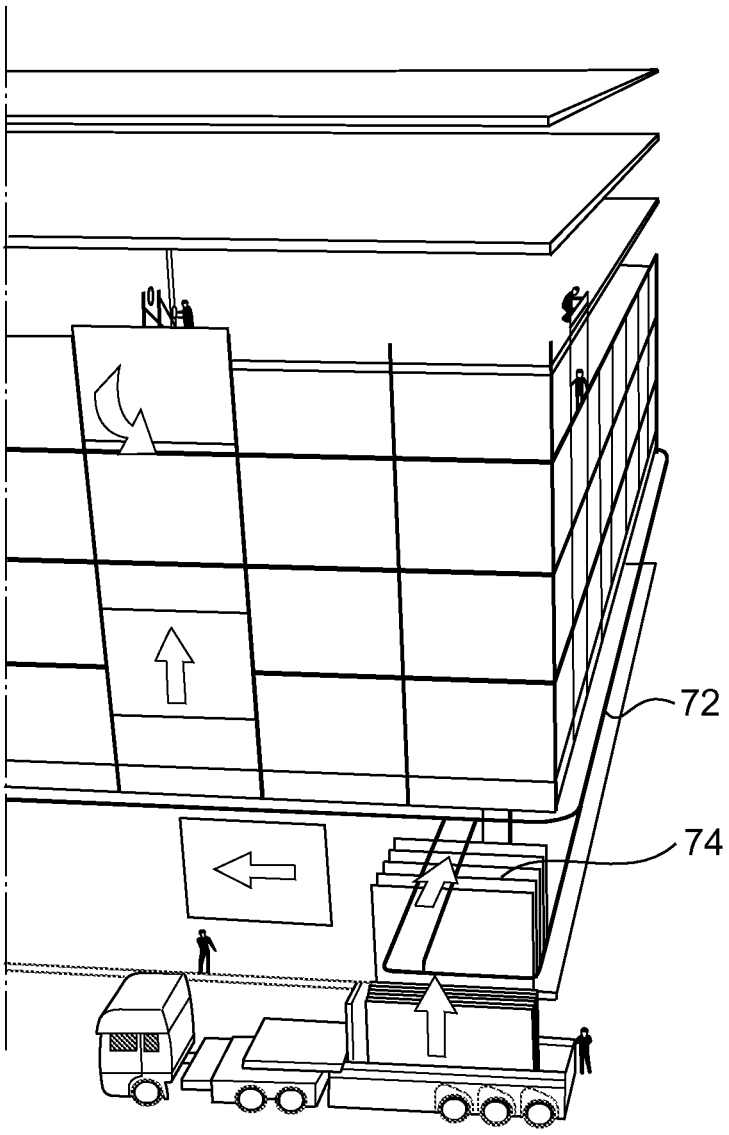
FIG. 20 shows the whole line of transportation of facade elements from delivery to the foot of the building to the installation place on the building.

FIG. 20 shows the whole line of transportation of facade elements 12 from delivery by truck trailer to the base of the building to the installation place on the building. As seen from the figure, the first row of vertical profiles is mounted at a distance from the base of the building in order to make it possible to insert the facade elements into the profiles. A conveyer system including a conveyer track 72 is arranged around the building for providing horizontal transportation of the facade elements. The conveyer track is running around, at least a part of the building, and preferably around the entire building. The conveyer system is mounted close to the lower part of the vertical profiles of the first floor, which is to be provided with facade elements. The conveyer system comprises equipment for automatically unloading facade elements from the truck trailer in an unloading position, and an intermediate storage 74 of the facade elements, and horizontal transportation of facade elements from the intermediate storage 74 to a desired horizontal position. When a facade element reaches the desired horizontal position, the facade element is vertically moved to the mounting position guided by the grooves of the second type of profiles mounted on the building.

Figure 21:
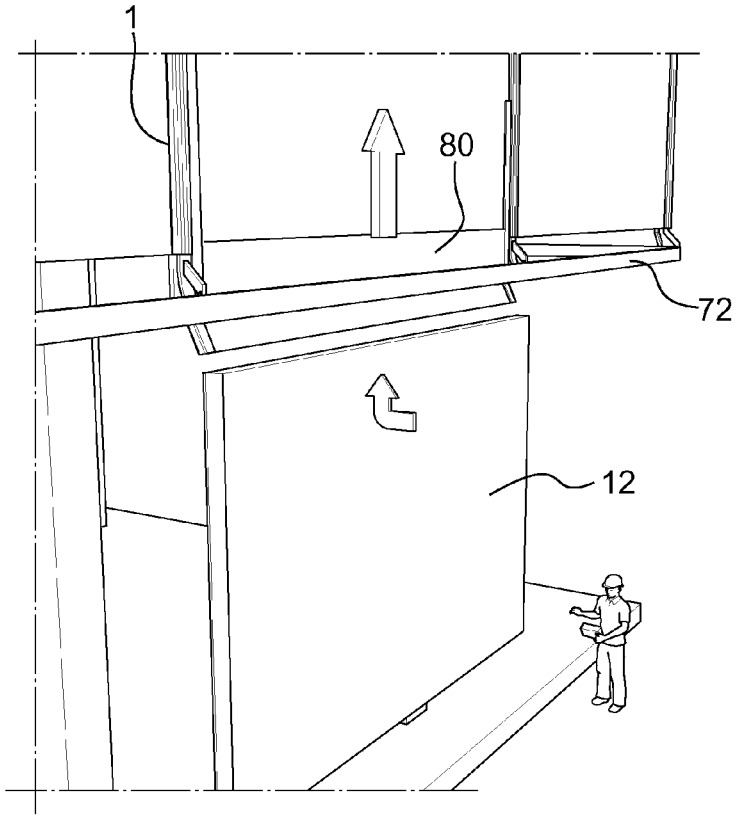
FIG. 21 shows an example of how a facade element is transferred from a conveyer system to an elevator unit.
Figure 22:
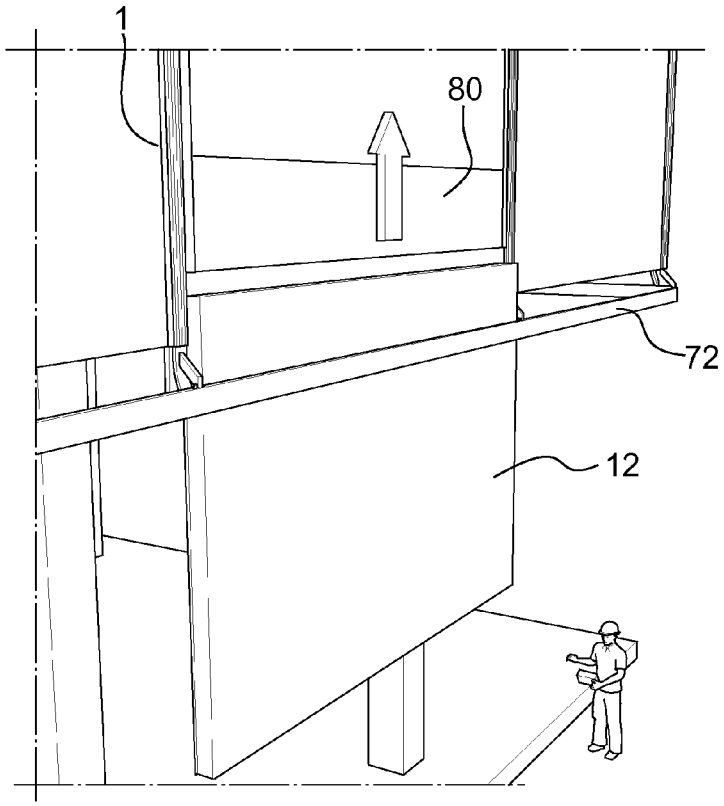
FIG. 22 shows a facade element transported upward with its edges entered into the grooves of the vertical profiles of the second type.

FIG. 21 shows an example of how a facade element is transferred from the conveyer system to an elevator unit 80. FIG. 22 shows a facade element transported upward with its edges entered into the grooves of the vertical profiles of the second type. The facade elements are moved from the conveyer truck to the vertical profiles by means of an elevator unit 80 provided with a gripping device for gripping the facade elements. The gripping device is arranged to move the facade element in a direction towards the building thereby facilitating the insertion of the facade element into the grooves 15 of the second type 14 of vertical profile. The elevator unit 80 has been lowered to the lower ends of the vertical elements 1. The conveyer track 72 positions the facade element 12 below the elevator unit 80, as shown in FIG. 21.

A lower part of the elevator unit 80 begins to angle outward from the facade in a direction towards the facade element 12 to be mounted. As shown in the figure, the gripping device has been turned out far enough to grip the upper part of the facade element. When the elevator unit is moved upwards by means of the lifting device 22 the facade element is released from the conveyer track and the facade element is moved inwards towards the building when the lower part of the elevator unit is angled to a straight position. The upper edge of the facade element enters the grooves of the profile of the second type and the lifting device moves the elevator unit with the facade element to a desired mounting position. The facade element is guided by the grooves of the underlying already mounted profiles of the second type.

The invention claimed is:

1. A method for mounting facade elements (12,12*b-c*) on a multi-storey building by a profile system comprising providing first (1) and second (14) types of vertical profiles, the first type of vertical profile (1) having a slot extending along a longitudinal axis of the profile, and an inner part (5) of the slot being designed to receive an edge (13*c*) of a first facade element (12) and an outer part (6) of the slot being designed to receive and support the second type of vertical profile (14) arranged to support the first facade element, and the second type of profile is provided with a groove (15) extending along a longitudinal axis of the profile and designed to receive and support an edge (13) of a second facade element (12*c*), wherein the method further comprises:

a) mounting two vertical profiles (1*a-b*) of the first type at a second floor of the building so that the slots are facing each other, and above profiles (1*c-d*) of the first and second type previously mounted on a first floor, and so that the longitudinal axes of the profiles are aligned, b) transporting the first facade element (12) in a vertical direction guided by the grooves of the second type of profiles mounted on the first floor until it reaches the vertical profiles mounted on the second floor, c) entering the first facade element into the outer part of the slots of the vertical profiles mounted on the second floor, d) continuing transporting the first facade element in a vertical direction guided by the outer part of the slots of the vertical profiles mounted on the second floor until it reaches a mounting position, e) pushing the first facade element from the outer part of the slots to the inner part of the slots, f) attaching the first facade element to the building, and g) inserting vertical profiles of the second type into the outer part of the slots so that the grooves are facing each other.

2. The method according to claim 1, wherein the method further comprises:

h) mounting two vertical profiles (1) of the first type at a third floor of the building, so that the slots are facing each other, and above the profiles of the first and second type previously mounted on the second floor so that the longitudinal axes of the profiles are aligned, and i) transporting the second facade element (12*c*) guided by the grooves of the second type of vertical profiles, in a vertical direction until it reaches the vertical profiles mounted on the third floor, and repeating the steps c-g for the second facade element.

3. The method according to claim 2, wherein the first facade element (12) is pushed from the outer part (6) of the slots to the inner part (5) of the slots by a tool (20).

4. The method according to claim 3, wherein step (a) further comprises attaching a tool (20) to at least one of said two vertical profiles (1*a-b*) on the second floor, and steps (d) and (e) further comprise:

moving the first facade element (12) upward until it comes into contact with the tool, moving the first facade element upward to a position above the final mounting position, while the upward movement of the first facade element affects the tool so that the tool is turned into a working position, and lowering the first facade element towards the final mounting position thereby causing the tool to push the first facade element towards the inner part (5) of the slots.

5. The method according to claim 2, wherein step (a) further comprises attaching a tool (20) to at least one of said two vertical profiles (1*a-b*) on the second floor, and steps (d) and (e) further comprise:

moving the first facade element (12) upward until it comes into contact with the tool, moving the first facade element upward to a position above the final mounting position, while the upward movement of the facade element affects the tool so that the tool is turned into a working position, and lowering the first facade element towards the final mounting position thereby causing the tool to push the first facade element towards the inner part (5) of the slots.

6. The method according to claim 1, wherein the first facade element (12) is pushed from the outer part (6) of the slots to the inner part (5) of the slots by a tool (20).

7. The method according to claim 6, wherein the tool (20) is driven by a vertical down movement of the first facade element.

8. The method according to claim 6, wherein step (a) further comprises attaching a tool (20) to at least one of said two vertical profiles (1*a-b*) on the second floor, and steps (d) and (e) further comprises:

moving the first facade element (12) upward until it comes into contact with the tool, moving the first facade element upward to a position above the final mounting position, while the upward movement of the first facade element affects the tool so that the tool is turned into a working position, and lowering the first facade element towards the final mounting position thereby causing the tool to push the first facade element towards the inner part (5) of the slots.

9. The method according to claim 1, wherein step (a) further comprises attaching a tool (20) to at least one of said two vertical profiles (1*a-b*) on the second floor, and steps (d) and (e) further comprise:

moving the first facade element (12) upward until it comes into contact with the tool, moving the first facade element upward to a position above the final mounting position, while the upward movement of the first facade element affects the tool so that the tool is turned into a working position, and lowering the first facade element towards the final mounting position thereby causing the tool to push the first facade element towards the inner part (5) of the slots.

10. The method according to claim 1, wherein the vertical profiles of the first type (1) are provided with a first fastening element (25) designed to be engaged to a corresponding fastening member (30) on the building, and a second fastening element (26) designed to be engaged to a corresponding fastening unit (35) provided on the first facade element, and step (a) further comprises:

providing the second floor with at least two fastening members arranged at a distance from each other, and attaching the vertical profiles of the first type to the second floor by engaging the first fastening elements to the fastening member on the second floor, and step (f) further comprises attaching the first facade element (12) to the building by engaging the fastening units of the first facade element to the second fastening elements.

11. The method according to claim 10, wherein the first and second fastening elements (25,26) are integrated in a single unit (24) and comprise a common load bearing body (34).

12. The method according to claim 1, wherein the facade elements (12) are delivered to the building by a truck trailer, and the method comprises automatically moving the respective facade elements from the truck trailer to a storage position (74) located at a base of the building.

13. The method according to claim 1, wherein the method comprises transporting the respective facade elements (12) from a storage position (74) to a desired horizontal position by a conveyer system including a track (72) arranged around at least a part of the building.

14. The method according to claim 13, wherein the respective facade elements (12) are moved by an elevator unit (80) provided with a gripping device for gripping the respective facade elements, the gripping device being arranged to move the respective facade element in a direction towards to the building and thereby facilitating the insertion of the respective facade elements into the grooves (15) of the second type of vertical profiles (14), and the method comprises gripping the respective, facade elements by the elevator unit, and inserting the second facade element into the grooves of the second type of vertical profiles by the elevator unit, and the method comprises transporting the respective facade elements (12) from the storage position (74) to the elevator unit (80) by the conveyer system (72).

15. The method according to claim 1, wherein the first facade element is vertically moved by a lifting device (22) positioned on the floor at which the first facade element (12) is to be mounted or on a floor above the floor at which the first facade element (12) is to be mounted.

16. The method according to claim 15, wherein the respective facade elements (12) are moved by an elevator unit (80) provided with a gripping device for gripping the respective facade elements, the gripping device being arranged to move the respective facade element in a direction towards to the building and thereby facilitating the insertion of the respective facade elements into the grooves (15) of the second type of vertical profiles (14), and the method comprises gripping the respective facade elements by the elevator unit, and inserting the second facade element into the grooves of the second type of vertical profiles by the elevator unit, and the elevator unit (80) is guided by the grooves (15) of the second type of vertical profiles, and the elevator is vertically moved by the lifting device (22).

17. The method according to claim 1, wherein the respective facade elements (12) are moved by an elevator unit (80) provided with a gripping device for gripping the respective facade elements, the gripping device being arranged to move the respective facade element in a direction towards to the building and thereby facilitating the insertion of the respective facade elements into the grooves (15) of the second type of vertical profiles (14), and the method comprises gripping the respective facade elements by the elevator unit, and inserting the second facade element into the grooves of the second type of vertical profiles by the elevator unit.

18. The method according to claim 1, wherein a correct distance between the two vertical profiles of the first type during mounting of the profiles is ensured by a jig (23) having a length that corresponds to the length of a respective facade element.

19. The method according to claim 1, wherein said first type of vertical profile (1) has a second slot (4*b*) extending along the longitudinal axis of the profile on an opposite side of the profile with respect to the first mentioned slot (4*a*), and the second slot has an inner part designed to receive an edge of a respective facade element and an outer part designed to receive the second type of vertical profile, and the method comprises mounting one vertical profile (1*e*) of the first type at a horizontal distance from one of the profiles (1*a*) of the second floor so that the slots are facing each other, and above one profile previously mounted on the first floor so that the longitudinal axes of the profiles are aligned, and repeating the steps (b-g).

20. The method according to claim 1, wherein the method further comprises:

mounting an adaptor block (65) on top of the vertical profiles (1;1*a*,1*e*) of the first and second type and between two horizontally aligned respective facade elements, and mounting a continuous sealing strip (70) on top of the two horizontally aligned facade elements (12*b*-*c*) and on top of the adaptor block to seal between the facade elements and vertical profiles of different floors.

* * * * *